US007831183B2

(12) United States Patent
Oshiba et al.

(10) Patent No.: US 7,831,183 B2
(45) Date of Patent: Nov. 9, 2010

(54) ELECTROPHOTOGRAPH DEVELOPING ROLLER AND DEVELOPING APPARATUS EMPLOYING THE SAME

(75) Inventors: Takeo Oshiba, Tokyo (JP); Masahiro Anno, Tokyo (JP); Okushi Okuyama, Tokyo (JP); Satoshi Uchino, Tokyo (JP); Shinya Obara, Tokyo (JP); Ryuichi Hiramoto, Tokyo (JP); So Matsuya, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 162 days.

(21) Appl. No.: 11/856,187

(22) Filed: Sep. 17, 2007

(65) Prior Publication Data

US 2008/0069601 A1 Mar. 20, 2008

(30) Foreign Application Priority Data

Sep. 20, 2006 (JP) ..... 2006-254080

(51) Int. Cl.
*G03G 15/08* (2006.01)

(52) U.S. Cl. ..... 399/286

(58) Field of Classification Search ..... 399/286
See application file for complete search history.

(56) References Cited

U.S. PATENT DOCUMENTS

| | | | | |
|---|---|---|---|---|
| 6,330,417 | B1 * | 12/2001 | Behe et al. | 399/286 |
| 7,505,720 | B2 * | 3/2009 | Sugama et al. | 399/286 |
| 2002/0127033 | A1 * | 9/2002 | Inoue et al. | 399/279 |
| 2004/0190922 | A1 * | 9/2004 | Nakagawa et al. | 399/55 |
| 2004/0223792 | A1 * | 11/2004 | Aoki et al. | 399/281 |
| 2006/0018686 | A1 * | 1/2006 | Sano et al. | 399/286 |
| 2006/0147229 | A1 * | 7/2006 | Ishida et al. | 399/286 |
| 2006/0204286 | A1 * | 9/2006 | Tsubota et al. | 399/286 |

FOREIGN PATENT DOCUMENTS

| | | | |
|---|---|---|---|
| JP | 7-56434 | | 3/1995 |
| JP | 8-190263 | | 7/1996 |
| JP | 10020673 | A * | 1/1998 |
| JP | 2002-14535 | A | 1/2002 |

* cited by examiner

*Primary Examiner*—Quana M Grainger
(74) *Attorney, Agent, or Firm*—Cantor Colburn LLP

(57) ABSTRACT

A developing roller comprising: a shaft comprising an aluminum alloy; and a coating layer directly formed on a periphery of the shaft, the coating layer comprising a conducting agent and a binder comprising a resin, wherein the aluminum alloy comprises 0.2 to 0.8% by mass of silicon and 0.05 to 1.5% by mass of maganese, based on the total mass of the aluminum alloy.

23 Claims, 4 Drawing Sheets

ELECTROPHOTOGRAPH DEVELOPING ROLLER AND DEVELOPING APPARATUS EMPLOYING THE SAME

TECHNICAL FIELD

The present invention relates to an electrophotograph developing roller and to a developing apparatus employing the same.

BACKGROUND OF THE INVENTION

In the electrophotographic image forming method widely used in these days, a charged toner is brought in contact with or provided to oppose via a narrow interval an electrostatic latent image which is formed on an electrostatic latent image carrier (normally an electrophotographic photoreceptor) to visualize the electrostatic latent image by the toner, which is referred to as a developing process, thus a toner image is formed. Then, the toner image formed on the electrostatic latent image carrier is transferred to a regular paper sheet, followed by fixing, to obtain a final image.

As the method for forming the toner image, there are known (i) a two-component developing method in which a two-component developer formed from a carrier and a toner are used to charge the toner and perform development; and (ii) a one-component developing method in which only toner is used and the toner is charged by friction with the developing roller which conveys the developer or with the developer controlling member and the like to perform development. In the one-component developing method, since no carrier is used, the developing apparatus can be simplified, and thus it has been very widely used in recent years. The one-component development method has been receiving much attention in the recent trend of colorization because a non-magnetic one-component development method in which the toner contains no magnetic material can also be colorized.

In this method, unlike the two-component development method, carrier is not used and only toner is subjected to friction using the charging member, or alternatively the toner is charged by pressing on the developing roller surface, and thus this has great merit in that the structure of the developing device is not complex and can be made compact. As a result, it can be easily applied to color image forming apparatus which requires four or more developing mechanisms. In recent years in particular, progress has been made in making the devices lighter and more compact, and in printers, developing systems which use non-magnetic single-component developers have become a main stream.

In the non-magnetic one-component development system that have been used so far, a developing roller having an elastic layer made of silicon rubber at the outer periphery of the conductive shaft have been used. The charging of the toner is carried out by forming a thin layer of the toner on a developing roller using a charging member such as a metal plate or a roller and by causing friction with the layer. Accordingly, a developing device with an extremely simple mechanical structure is obtained.

The developing roller has an elastic layer made of, for example, silicon rubber on the outer periphery of a conductive shaft made from a metal or a conductive resin, and a surface layer may be formed on the elastic layer in order to impart charging property to the toner or to impart conveyance properties to the toner. As the surface layer, it has also been known that a fluorinated rubber can be used to prevent the toner from adhering to or fusing with the surface layer. In order to form the fluorinated rubber layer on the elastic layer, adhesive properties must be improved and a method of forming the elastic layer surface with an intermediate layer of a silane coupling agent and further forming a coating layer which has fluorinated rubber as its main component thereon is known (for example, see Patent Document 1).

Due to the more compact size and shorter printout times of recent devices, the cycle of toner conveyance, charging, development and toner replacement which are functions of the developing roller has become faster and the load of the developing roller has become increased.

In the developing roller which has a structure in which a coating layer is formed directly on the shaft, a stronger adhesion of the coating layer to the shaft is needed, since when a force is applied from the outside to the coating layer, the shock cannot be absorbed unlike in the case of the developing roller in which a coating layer is provided via an elastic layer.

Providing an adhesive layer between the shaft and the coating layer in order to improve the adhesive properties between the shaft and the coating layer has been examined (for example, see Patent Document 2).

In addition, using stainless steel to form the shaft and forming a coating layer directly on the shaft has been examined (for example, see Patent Document 3).

However, in the developing roller which has a structure in which a coating layer is formed directly on the shaft as mentioned above, the adhesion of the coating layer to the shaft has not been strong enough, and it has not been fully easy, when a large number of images are printed, to continuously obtain high quality toner images due to peeling of the coating layer from the shaft.

| | |
|---|---|
| Patent Document 1 | Unexamined Japanese Patent Application Publication (hereafter referred to as JP-A) No. 8-190263 |
| Patent Document 2 | JP-A No. 7-56434 |
| Patent Document 3 | JP-A No. 2002-14535 |

SUMMARY OF THE INVENTION

An object of the present invention is to provide a developing roller having an excellent adhesiveness of the coating layer to the shaft, by which high quality toner images can be continuously obtained even after printing a large number of images, and a developing apparatus using the developing roller.

One of the aspects to achieve the above object of the present invention is a developing roller comprising: a shaft comprising an aluminum alloy; and a coating layer directly formed on a periphery of the shaft, the coating layer comprising a conducting agent and a binder comprising a resin, wherein the aluminum alloy comprises 0.2 to 0.8% by mass of silicon and 0.05 to 1.5% by mass of manganese, based on the total mass of the aluminum alloy.

DESCRIPTION OF THE PREFERRED EMBODIMENTS

Figure 1:
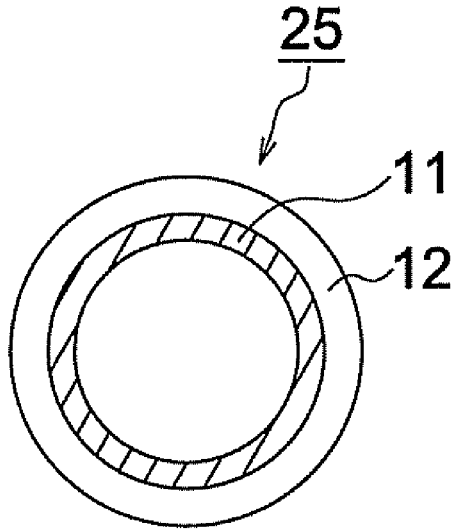
FIGS. 1(*a*) and 1(*b*) are schematic cross-sectional views showing examples of the developing roller of the present invention.
Figure 1:
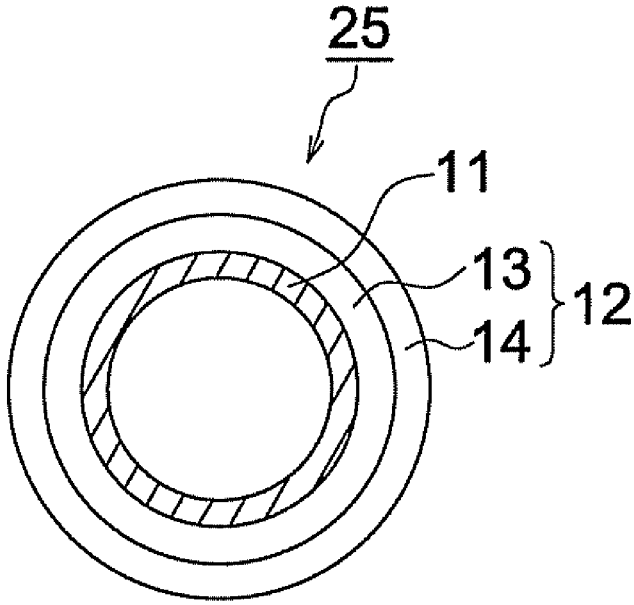

The developing roller of the present invention exhibits an effect that interlayer adhesion between the shaft and the coating layer is excellent, and high quality toner images can be continuously obtained even after a large number of copies are printed.

In the present invention, it was found that, by using a shaft of a developing roller containing an aluminum alloy appropriately added with a prescribed element, the adhesion between the shaft and the coating layer is improved and high quality toner images can be continuously obtained even after a large number of copies are printed.

It can be deduced that the reason why the interlayer adhesion was improved and high quality toner images could be continuously obtained is that the element added to the aluminum alloy crystallized on the surface of the shaft as an eutectic crystal according to the added amount, and this portion functioned as an adhesion point with the coating layer and thereby the adhesion was improved, however, no theoretical explanation has not been made so far.

In the present invention, the material used for the shaft is an aluminum alloy which contains predetermined amounts of silicon and manganese. Further preferable is an aluminum alloy containing predetermined amounts of magnesium and chromium in addition to the above elements.

There is a suitable range for amount of the element included in each element, and the amount of silicon (Si) is 0.2-0.8 percent by mass while the amount of manganese (Mn) is 0.05-1.5 percent by mass, based on the total mass of the aluminum alloy.

Furthermore, the amount of magnesium is preferably 0.4-6.0 percent by mass, while the amount of chromium is preferably 0.04-0.35 percent by mass, based on the total mass of the aluminum alloy.

When the element contents in the aluminum alloy are in the above range, the interlayer adhesion is improved and high quality toner images can be continuously obtained.

The elements and amounts thereof included in the aluminum alloy can be measured using inductively coupled plasma emission spectrometry.

Inductively coupled plasma emission spectrometry refers to a method in which a solution sample in which metals are dissolved, for example, in an acid or an alkali is sprayed into Ar plasma and the emitted light by excitation is divided into the respective wavelengths and the kinds and amounts of elements contained are determined from the light intensities. In this method, a liner relationship between the light intensity and the amount of element can be obtained in all the regions from the small amount to high concentration and thus the each element can be analyzed simultaneously.

"ULTIMA 2000" manufactured by HORIBA may be used as the measuring device for inductively coupled plasma emission spectrometry.

The present invention will be described in detail in the following.

<<Structure of Developing Roller>>

The developing roller of the present invention is fabricated by directly forming a coating layer containing at least a resin and a conductive agent on the outer periphery of a shaft made of an aluminum alloy containing at least silicon and manganese.

FIGS. 1(*a*) and 1(*b*) are cross-sectional schematic views showing examples of the developing rollers of the present invention.

FIGS. 1(*a*) and 1(*b*), 25 is the developing roller, 11 is a shaft, 12 is the coating layer, 13 is the lower layer and 14 is the upper layer.

As shown in FIG. 1(*a*), the developing roller of the present invention may be one in which a coating layer 12 is provided directly on the shaft 11 or as shown in FIG. 1(*b*), one in which a lower layer 13 is provided directly on the shaft 11 and then an upper layer 14 is provided thereon to form a coating layer 12 with a multilayer structure. It is to be noted that the lower layer and the upper layer may be formed of multiple layers.

<Interlayer Adhesion Strength>

The developing roller of the present invention is characterized in that the interlayer adhesion strength between the shaft and the coating layer is made strong.

The interlayer adhesive strength between the shaft and the coating layer is measured by the method described below to evaluate.

Figure 2:
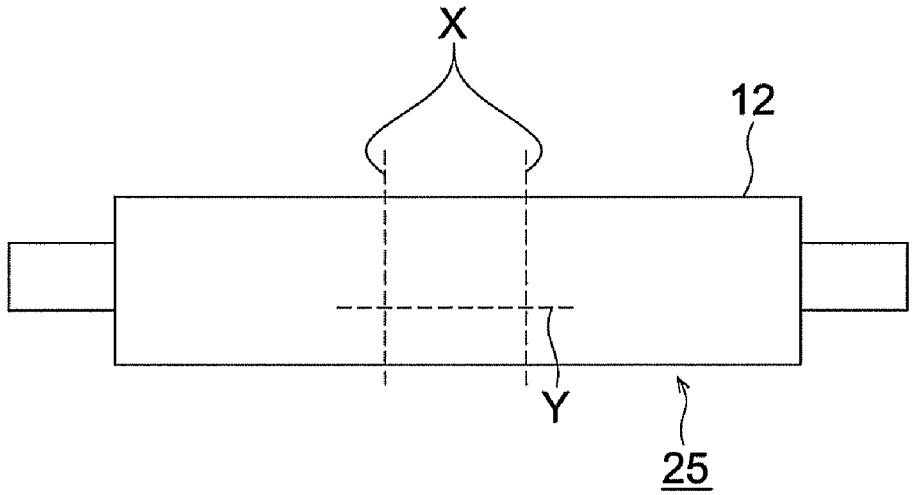
FIGS. 2(*a*) and 2(*b*) are schematic illustrations explaining the method of measuring the interlayer adhesive strength between the shaft and the coating layer.
Figure 2:
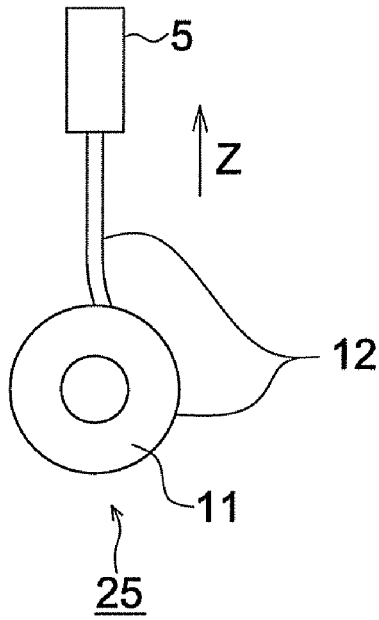

FIGS. 2(*a*) and 2(*b*) are schematic illustrations for explaining the method of measuring the interlayer adhesive strength between the shaft and the coating layer.

As shown in FIG. 2(*a*), two cuts of a width of 2.5 cm as shown by the dotted lines X are made on the coating layer 12 along its outer periphery in the center portion of the roller. In addition, another cut (dotted line Y) is made on the coating layer 12 along the shaft 11 direction and a small portion of coating layer 12 is forcibly peeled, for example, using a knife from that portion and as shown in FIG. 2(*b*), the end portion of the peeled coating layer is held by a tension tester 5 and it is pulled up vertically (in the arrow Z direction) to evaluate the interlayer adhesion strength by measuring the forth of lifting strength at which the coating layer begins to be further peeled from the shaft. In the present invention, a high precision universal tester "autograph AGS (manufactured by Shimadzu Corporation)" was used as the tension tester.

More specifically, in the process in which the coating layer was lifted up at a speed of 100 mm/min and the load capacitance was increased to 20N, the load value was obtained for the point where coating layer was lifted up even without increasing the load.

Next, the material used for forming the developing roller of the present invention will be described.

<<Shaft>>

In the material of the shaft used in the invention, the amount of silicon with respect to the total amount of the aluminum alloy is 0.2-0.8 percent by mass while the amount of manganese is 0.05-1.5 percent by mass and furthermore, the amount of magnesium is preferably 0.4-6.0 percent by mass, while the amount of chromium is preferably 0.04-0.35 percent by mass.

The outer diameter of the shaft is preferably 5-30 mm and more preferably 10-20 mm. Since the shaft also has a function to leak the accumulated charge on the developing roller surface, the resistivity of the shaft is preferably $1\times10^4$ Ω·cm or less. More specifically, it is preferable that flanges are installed at both ends of a hollow aluminum alloy sleeve (thickness 0.8-2.0 mm) for lightening the shaft. The resistivity of the shaft can be measured by a known method.

<<Coating Layer>>

The coating layer is formed as follows: (i) preparing a coating liquid by suitably blending a conducting agent (an Conducting agent or an ion conducting agent), a binder and, if necessary, a non-conductive filler; (ii) applying the coating liquid on the outer peripheral surface of the shaft; and (iii) drying the coated shaft and, if desired, heating it to harden the coating layer. The material used for the binder is not specifically limited as far as a coating layer containing the above conducting agent and, if necessary, the non-conductive filler can be formed. However, in the present invention, the binder preferably contains a resin, and, more preferably, the binder consists only of a resin.

<Coating Layer Resin>

The resin of the coating layer is not specifically limited, but specific examples include a siloxane modified polyurethane resin, an acrylic resin, a urea resin, a melamine resin, an alkyd resin, a modified alkyd resin (for example, phenol modified or silicone modified), an oil-free alkyd resin, a silicone resin, a fluorine-containing resin, a phenol resin, a polyamide resin, an epoxy resin, a polyester resin, a maleic acid resin and an urethane resin. Of these, a siloxane modified polyurethane resin, an acrylic resin and a polyamide resin are preferably used in view of self reinforcement of film and toner charging properties. Among these, a siloxane modified polyurethane resin is specifically preferable in view of obtaining favorable abrasion resistance.

An urethane resin can be obtained by reacting a polyhydroxy compound and an urethane raw material including an isocyanate compound, and examples include those obtained by a method for cross-linking prepolymers or a method for reacting a polyol with polyisocyanate using the one shot method.

In this case, examples of the polyhydroxyl compound used for obtaining the urethane resin include: polyols used for manufacturing a common soft polyurethane foam or a urethane elastomer, for example, a polyether polyol, a polyester polyol and a polyether polyester polyol, each having a polyhydroxyl group at the terminal. Also usable are common polyols such as: polyolefin polyols, for example, polybutadiene polyol and polyisoprene polyol; and so-called polymer polyol obtained by polymerizing ethylenically unsaturated monomers in a polyol. In addition, examples of the isocyanate include: polyisocyanates used for manufacturing common soft polyurethane foam and urethane elastomers such as: toluene diisocyanate (also referred to as TDI), crude TDI, 4,4'-diphenyl methane diisocyanate (also referred to as MDI), crude MDI, aliphatic polyisocyanate having 2-18 carbon atoms, alicyclic polyisocyanate having 4-15 carbon atoms, mixtures of the above polyisocyanates and modified isocyanate compounds thereof, for example, prepolymers obtained by partially reacted with a polyol. In particular, in order to reduce the universal hardness of the coating layer, the mixing ratio of the polyisocyanate may be reduced.

The urethane resin may be prepared by using single solution type or a double solution type urethane material which includes a polyhydroxyl compound and a polyisocyanate. If necessary, epoxy resin or melamine resin may be used as a cross-linking agent.

The polyamide resin is a polyamide obtained from condensation polymerization of polyamide 6,6·6,6·10,6·12,11,12, 12·12 and the different monomers of these polyamides. Of these, preferably used are those which are soluble in alcohol in view of working properties. Examples of a polyamide resin include: a polyamide in which the molecular weight of ternary copolymer or a quaternary copolymer is adjusted; and a polyamide in which polyamide 6 or polyamide 12 is methoxymethylated and made soluble in alcohol or water.

Examples of an acrylic resin include: polyacrylate, polymethylmethacrylate, polymethylethacrylate, these resins in which the side chain terminal is substituted with a hydroxyalkyl group, and the copolymers thereof.

Examples of a monomer which form the acrylic resin include: methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-amino acrylate, stearyl methacrylate, dimethylamino ethyl methacrylate and diethylamino ethyl methacrylate.

The resin used in the present invention is preferably a silicone copolymer polyurethane resin. The silicone copolymer polyurethane resin can be synthesized using a polyvalent isocyanate (divalent or more) and a compound containing a polyvalent silicone moiety having two or more hydroxide groups in the molecule.

The silicone copolymer polyurethane resin is not specifically limited, but those disclosed in JP-A No. 7-33427 may be used.

As the siloxane modified polyurethane resin, usable is a siloxane modified polyurethane resin containing an alkoxy group which is formed by reacting: (1) a polyurethane resin which is obtained from a polyol, an isocyanate and a chain extending agent, and has a functional group which is reactive with an epoxy group; and (2) an alkoxy silane partial condensate having an epoxy group which is obtained by a dealcoholization reaction between an epoxy compound (A) which has 1 hydroxide group in 1 molecule (simply called epoxy compound (A) hereinafter) and an alkoxysilane partial condensate (B). However, the present invention is not limited thereto.

The functional group which is reactive with the epoxy group in the polyurethane resin (1) may be present on the end of or on the main chain of the polyurethane resin (1). Examples of the functional group include an acid group such as a carboxyl group, a sulfonate group, a phosphate group, an amino group, a hydroxide group, and a mercapto group. The acid group and the amino group are preferable in view of reactivity with the epoxy group and ease of functional group transfer. The method for transferring the acid group to the polyurethane resin (1) is not specifically limited, but the functional group may be transferred by using a compound including the foregoing functional groups as the chain extending agent or the polymerization terminator.

Examples of methods for manufacturing the polyurethane resin (1) used in the present invention include: a one stage method in which a polyol polymer, a diisocyanate compound and if necessary, a chain extending agent and/or a terminator are reacted in a suitable solvent; and a two stage method in which a prepolymer having an isocyanate group at the end of a polyol polymer is prepared and the resultant is reacted in a suitable solvent with a chain extending agent and, if necessary, with a polymerization terminator. The two-stage method is favorable in order to obtain a uniform polymer solution. The solvent used in these manufacturing methods is usually an aromatic solvent such as benzene, toluene and xylene; ester based solvents such as ethyl acetate; butyl acetate; alcohol based solvents such as methanol, ethanol, isopropanol, n-butanol and diacetone alcohol; ketone based solvents such as acetone, methylethyl ketone, methyl isobutyl ketone as well as dimethyl formamide, dimethyl acetoamide, ethylene glycol dimethylethyl ether, tetrahydrofuran and cyclohexanone, and these may be used alone or in combination.

The method for adding the amino group to the polyurethane resin (1) is not limited, but polyamides may be reacted with the terminal isocyanate group of the prepolymer, for example, such that there is an excess of the amino group. The amount of the functional group which is reactive with the epoxy group in the polyurethane resin (1) is not specifically limited, but usually is preferably between 0.1-20 KOHmg/g. If the amount is less than 0.1 KOHmg/g, the softness and heat resistance of the obtained polyurethane resin-silica hybrid will be reduced, while if it exceeds 20 KOHmg/g, there is a tendency for the water resistance of the polyurethane resin-silica hybrid to reduce. It is to be noted that a polyurethane resin-silica hybrid which contains a urea bond in the polyurethane resin is preferable in view of interlayer adhesion.

As described above, the alkoxy silane partial condensate including epoxy (2) of the present invention is obtained by a dealcoholization reaction between an epoxy compound (A) and an alkoxy silane partial condensate(B).

The number of epoxy groups in the epoxy compound (A) is not specifically limited provided that it has one hydroxide group in one molecule. The epoxy compound (A) having a smaller molecular weight exhibits a higher compatibility to the alkoxy silane partial hydrogenate (B), a higher heat resistance and a higher effect of providing adhesion, and thus the number of carbon atoms is preferably 15 or less. Specific examples include: monoglycidyl ethers having one hydroxyl group at the molecule end that is obtained by reacting epichlorohydrin with water, and divalent alcohols or phenols; polyglycidyl ethers having one hydroxyl at the molecule end that is obtained by reacting epichlorohydrin with polyvalent alcohols of a valency of three or more such as glycerin and pentaerythritol; epoxy compounds having one hydroxyl group at the molecule end that is obtained by reacting epichlorohydrin with amino monoalcohol; and cyclic hydrocarbon monoepoxide having one hydroxyl group in one molecule (for example epoxide tetrahydrobenzyl alcohol). Of these epoxy compounds, glycidol is most preferable in view of the effect of imparting heat resistance and it is suitable because of its high reactivity with the aloxysilane partial condensate (2).

In addition, examples of the alkoxysilane partial condensate (B) are those represented by General Formula (a) below obtained by hydrolyzing a hydrolyzable alkoxysilane monomer in the presence of acid or alkaline water to perform partial condensation.

General Formula (a):

$$R^1_p Si(OR^2)_{4-p}$$

(In the formula, p represents 0 or 1. $R^1$ represents a lower alkyl group which may have a functional group directly bonded to a carbon atom, an aryl group or an unsaturated aliphatic residual group. $R^2$ represents a methyl group or an ethyl group and the $R^2$ groups may be the same or different.)

Specific examples of addition hydrolyzed alkoxysilane monomers include: tetra alkoxysilanes such as tetra methoxysilane, tetra ethoxysilane, tetra propoxysilane and tetra isopropoxysilane; and trialkoxysilanes such as methyl trimethoxysilane, methyl triethoxysilane, methyl tripropoxysilane, methyl tributoxysilane, ethyl trimethoxysilane, ethyl triethoxysilane, n-propyl trimethoxysilane, n-propyl triethoxysilane, isopropyl trimethoxysilane. It is to be noted that the alkoxysilane partial condensates (B) in the examples above are not specifically limited, but when 2 or more of these examples are mixed and used, it is preferable that 70 mole % or more of tetramethoxysilane is used, based on the total alkoxysilane monomers forming the alkoxysilane partial condensate (B). By adjusting the proportion of the silane moiety included in the polyurethane resin-silica hybrid within 1.0 percent and 30.0 percent by mass, an extremely stable adhesive property is obtained.

The alkoxysilane partial condensate (B) may be, for example, represented by the following General Formulas (b) and (c).

General Formula (b)

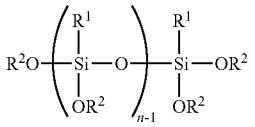

(In the formula, $R^1$ represents a lower alkyl group which may have a functional group directly bonded with a carbon atom, an aryl group or an unsaturated aliphatic residual group. $R^2$ represents a methyl group or an ethyl group and the $R^2$ groups may be the same or different. n is an integer.)

General Formula (c)

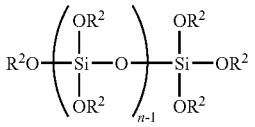

(In General Formula (c) $R^1$ and $R^2$ are the same as in General Formula (b). n is an integer)

<Conducting agent>

Examples of the conducting agent which can be used include various conductive metals and alloys such as carbon black, graphite, aluminum, copper, tin, stainless steel; various conductive metal oxides such as tin oxide, zinc oxide, indium oxide, titanium oxide, a solid solution of tin oxide and antimony oxide, and a solid solution of tin oxide and indium oxide; and powders of insulating material coated with these conductive material. Of these, carbon black is preferably used in view of the fact that is comparatively readily available and can obtain a favorable toner charging property.

The type of carbon black is not specifically limited, and various known carbon blacks such as Ketchen black, channel black, furnace black and the like can be used. The blending amount of carbon black used varies depending on the type of carbon black used and thus is not specifically limited, but is usually preferable that the amount is 5-50 parts by mass, and more preferably 10-40 parts by mass for 100 parts by mass of the resin component. The blending amount is suitably set in accordance with conductivity required for the coating layer and universal hardness.

<Ion Conducting Agent>

Any inorganic ion salt or organic ion salt known heretofore may be suitably selected and used as the ion conducting agent. Specific examples include: alkali metal halides such as Li, LiCl, NaI, NaBr, KI and the like; perchlorates such as $LiClO_4$, $KClIO_4$, $CuCl_2Mg(ClO_4)_2$; inorganic ion salts like thiocyanates such as LiSCN, NaSCN, CsSCN and the like, organic ion salts such as aliphatic sulfonates, fatty alcohol sulfate, fatty alcohol ester phosphate, fatty alcohol ethylene oxide addition ester sulfate, fatty alcohol ethylene oxide addition ester phosphate, quaternary ammonium salts, betaine and the like. Of these, particularly preferable are quaternary ammonium salts such as trimethyl octadecyl ammonium perchlorate, tetramethyl ammonium chloride, and benzyl trimethyl ammonium chloride. These ion conducting agents may be used singly or in combinations of two or more.

The blending amount of the ion conducting agent is not specifically limited and may be suitably selected in accordance with various conditions, but it is preferably 0.001-5 parts by mass and more preferably 0.05-2 parts by mass to 100 parts by mass of the resin comprising the coating layer.

As the result, obtained is a coating layer exhibiting a reduced positional variation of electrical resistivity, a low voltage dependency of electrical resistivity and a reduced variation in electric resistivity against environmental changes such as in temperature or in humidity, in the resistivity range of $1\times10^4$–$1\times10^{10}$ Ω·cm.

Next, manufacture of the developing roller will be described.

<<Preparation of Shaft>>

The shaft is made using an aluminum alloy including the aforementioned elements.

The shaft is preferably a thin (for example, 0.5-2.0 mm) hollow cylindrical shaft with a small diameter (outer diameter of 5-30 mm) to which flanges are mounted, in order to make the image forming apparatus more compact, lighter and lower in cost.

<<Preparation of the Coating Layer>>

The means for forming the coating layer directly on the outer periphery of the shaft is preferably a method in which a coating liquid in which the aforementioned component materials (binder, conducting agent and non-conductive filler if necessary) are dissolved in an organic solvent and dispersed, is coated on the shaft. The resin component concentration in the coating liquid is not specifically limited, and may be suitably adjusted in accordance with the required layer thickness, but the resin component concentration is preferably 10 percent by mass or more in view of dispersion and stability of the solid substances in the coating liquid. In the present invention, the binder preferably contains a resin, and, more preferably, the binder consists only of a resin.

The solvent used for adjusting the resin component concentration in the coating liquid is not specifically limited provided that it can dissolve the resin components and examples include: lower fatty alcohols such as methanol, ethanol and isopropanol; ketones such as methyl ethyl ketone; cyclohexane; toluene; and xylene.

The method for forming the coating layer depends on the viscosity of the resin components which form the coating layer, for example, methods, such as a dipping method, a spray coating method, a roll coater method and a brush coating method, may be used, but, of these, the dipping method and the spray coating method are preferable, because an even coating layer is easily formed.

The thickness of the coating layer is preferably 1-30 μm and more preferably 5-20 μm. The thickness of the coating layer is measured by taking a cross-section which includes the coating layer from the development roller and the cross-section sample and then this is measured using microscope photography.

It is to be noted that the shaft used is formed from the aluminum alloy and the outer diameter is preferably 5-30 mm and it is preferably a hollow cylinder of thickness 0.8-2.0 mm that has been subjected to processing.

Next, the non-magnetic single component developing agent (simply called toner hereinafter) used in image formation using the developing roller of the present invention will be describe. The toner that can be used in image formation which uses the developing roller of the present invention is a so-called ground toner which is manufactured via the grinding and classification step. Also a polymer toner which is directly manufactured from a polymerization step in which resin particles are formed may also be used. Of these, the polymer toner in particular is favorable for making toner with small particle diameter in which the particles have the same shape because the toner particle size and configuration can be controlled in the preparation step.

By using small particle diameter toner in which the particles have the same shape, high resolution and high definition image formation which is required for digital image formation can be easily carried out and it is particularly preferable for high gradient pictorial full color image for example. In addition, by combining this with the developing roller of the present invention, it is expected that high definition full color image formation can be performed stably.

Meanwhile, examples of the polymer toner include an emulsion associated type toner which is formed in the manufacturing step thereof by flocculating particles and forming toner particles, but a small amount of the flocculating agent used remains on the surface of the toner particles that are made. This type of residual substance attaches to the surface of the developing roller and the effect on the residual charge on the surface of the developing roller has been a cause for concern.

However, the developing roller of the present invention, even when image formation is repeatedly carried out using a polymer toner, favorable image formation is carried out without any occurrence of increase in residual charge on the developing roller surface, and this is confirmed by the working examples described hereinafter.

The following is a description of the elements comprising the polymer toner which is one example of the toner that can be used for image formation using the developing roller of the present invention.

(Monomer)

The monomer is one in which a radical polymerizable monomer is a required structural component and a cross-linking agent may be used as necessary. In addition, it preferably includes at least one of a radical polymerizable monomer including the acid group below and the radical polymerizable monomer including the base group.

(1) Radical Polymerizable Monomer

The radical polymerizable monomer is not specifically limited, and any radical polymerizable monomer known heretofore may be used. In addition, one or more types may be used in combination in order to meet the required properties.

Specifically, an aromatic vinyl monomer, a (meta) ester acrylate monomer, a vinyl ester monomer, a vinyl ether monomer, a monoolefin monomer, a diolefin monomer, a halogenated olefin monomer and the like may be used.

Examples of the aromatic vinyl monomer include styrene monomers and derivatives thereof such as styrene, o-methyl styrene, m-methyl styrene, p-methyl styrene, p-methoxy styrene, p-phenyl styrene, p-chlorostyrene, p-ethyl styrene, p-n-butyl styrene, p-tert-butyl styrene, p-n-hexyl styrene, p-n-octyl styrene, p-n-nonyl styrene, p-n-decyl styrene, p-n-dodecyl styrene, 2,4-dimethyl styrene, 3,4-dichloro styrene and the like.

Examples of the meta(ester) acrylate monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-amino acrylate, stearyl methacrylate, dimethyl amino ethyl methacrylate, diethyl amino ethyl methacrylate and the like.

Examples of the vinyl ester monomer include vinyl acetate, vinyl propionate, vinyl benzoate and the like.

Examples of the vinyl ether monomer include vinyl methyl ether, vinyl ethyl ether, vinyl isobutyl ether, vinyl phenyl ether and the like.

Examples of monoolefin monomer include ethylene, propylene, isobutylene, 1-butene, 1-pentene, 4-methyl-1-pentene and the like.

Examples of the diolefin monomer include butadiene, isoprene, chloroprene and the like.

Examples of the halogenated olefin monomer include vinyl chloride, vinylidene chloride, vinyl bromide and the like.

(2) Cross-Linking Agent

A radical polymerization cross-linking agent may be added as the cross-linking agent in order to improve the toner properties. Examples of the radical polymerization agent include those having 2 or more unsaturated bonds such as divinyl benzene, divinyl naphthalene, divinyl ether, diethylene glycol methacrylate, ethylene glycol dimethacrylate, polyethylene glycol dimethacrylate, diaryl phthalate and the like.

(3) Radical Polymerizing Monomer Including Acidic Group or Basic Group

Examples of the radical polymerizing monomer including an acidic group or the radical polymerizing monomer including a basic group include a monomer including a carboxyl group, a monomer including a sulfonate group, amine based compounds such as a primary amine, a secondary amine, a tertiary amine and quaternary ammonium salts.

Examples of a monomer including a carboxylic acid group which is a radical polymerizing monomer including an acidic group include acrylic acid, methacrylic acid, fumaric acid, maleic acid, itaconic acid, cinnamic acid, monobutyl ester maleate, monooctyl ester maleate and the like.

Examples of the monomer including a sulfonic acid group include styrene sulfonate, aryl sulfosuccinate, octyl aryl sulfosuccinate and the like.

These may comprise alkali metal salts such as those of sodium and potassium or alkali earth metal salts such as calcium and the like.

The radical polymerizing monomer including a basic group are amine based compounds, and examples include dimethyl amino ethyl acrylate, dimethyl amino ethyl methacrylate, dimethyl amino ether acrylate, diethyl amino ethyl methacrylate, and quaternary ammonium salts of the 4 previous compounds, 3-dimethyl amino phenyl acrylate, 2-hydroxy-3-metacryloxypropyl trimethyl ammonium salts, acrylamide, N-butyl acryl amide, N,N-dibutyl acryl amide, piperydyl acryl amide, metacryl amide, N-butyl metacryl amide, N-octadecyl acryl amide, vinyl pyridine, vinyl pyrrolidone; vinyl-N-methyl pyridium chloride, vinyl-N-ethyl pyridium chloride, N,N-diaryl methyl ammonium chloride, N-N-diaryl ethyl ammonium chloride and the like.

It is preferable that 0.1-15 percent by mass of the radical polymerizing monomer including an acidic group or the radical polymerizing monomer including a basic group with respect to the total amount of monomers is used. The amount of radical polymerizing cross-linking agent used depends on the properties thereof, but the amount is preferably in the range of 0.1-10 percent by mass with respect the total mount of radical polymerizing monomers.

(Chain Transfer Agent)

Any commonly used chain transfer agent may be used in order to adjust molecular weight.

The chain transfer agent is not specifically limited and examples thereof include octyl mercaptan, dodecyl mercaptan, tert-dodecyl mercaptan, n-octyl-3-mercapto ester propionate, carbon tetrabromide, styrene dimmer and the like.

(Polymerization Initiator)

Any water soluble radical polymerization initiator may be suitably used. Examples include persulfates (potassium persulfate and ammonium persulfate and the like), azo-based compounds (4,4'-azo bis-4-cyano valeric acid and salts thereof, 2,2'-azo bis (2-amino propane) salts and the like)) and peroxide compounds and the like.

Furthermore, the radical polymerizing monomer initiator may be combined with a reducing agent as necessary to form a redox type initiator. By using the redox type initiator, it can be expected that the polymerization activity will be increased and polymerization temperature will be reduced and further the polymerization time will be shortened.

Any temperature can be selected as the polymerization temperature provided that it is greater than the minimum radical formation temperature of the polymerization initiator, and the range may, for example, be from 50° C. to 90° C. That is to say, by using a polymerization initiator for normal temperature initiation such as a hydrogen peroxide—reducing agent (ascorbic acid and the like) combination, polymerization is possible at room temperature or a temperature somewhat higher than room temperature.

(Surfactant)

In order to perform polymerization using the radical polymerizing monomer, it is necessary to use a surfactant and perform oil droplet dispersion in a water based medium. The surfactants which can be used at this point are not specifically limited, but examples of preferable ionic surfactant are listed below.

The ionic surfactant include sulfonate salts (sodium dodecyl benzene sulfonate, sodium aryl alkyl polyether sulfonate, 3,3-disulfon diphenyl urea-4,4-diazo-bis-amino-8-naphtol-6-sulfonate, ortho-carboxybenzene-azo-dimethyl aniline, sodium 2,2,5,5-tetramethyl-triphenyl methane-4,4 diazo-bis-β-naphtol-6-sulfonate and the like), ester sulfates (sodium dodecyl sulfate, sodium tetradecyl sulfate, sodium pentadecyl sulfate, sodium octyl sulfate and the like) fatty acid salts (sodium oleate, sodium laureate, sodium caprate, sodium caprylate, sodium caproate, potassium stearate, calcium oleate and the like).

In addition, a non-ionic surfactant may also be used. Specifically, a polyethylene oxide, polypropylene oxide, a combination of polypropylene oxide and polyethylene oxide, an ester of polyethylene glycol and higher fatty acid, alkyl phenol polyethylene oxide, an ester of higher fatty acid ester and polyethylene glycol, an ester of higher fatty acid and polypropylene oxide, sorbitan ester and the like. These may be used as an emulsifying agent mainly at the time of emulsification polymerization, but they may also be used in other steps or for other purposes.

(Coloring Agent)

Inorganic pigments, organic pigments and colorants may be used as the coloring agent.

The inorganic pigments used may be those known heretofore. Specific examples of the inorganic pigments are shown below.

Examples of black pigments include carbon black such as furnace black, channel black, acetylene black, thermal black, lamp black as well as magnetic powders such as magnetite and ferrite may be used.

These inorganic pigments may be used singly, or multiple inorganic pigments may be selected and used together. In addition, the amount of the pigment added is preferably 2-20 percent by mass with respect to the polymer, and more preferably 3-15 percent by mass.

The organic pigments and colorants used also may be those known heretofore. Specific examples of the organic pigments and colorants are listed below.

Examples of pigments for magenta and red include C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 222 and the like.

Examples of pigments for orange and yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, C.I. pigment yellow 185, C.I. pigment yellow 155, C.I. pigment yellow 156 and the like.

Examples of pigments for green and cyan include C.I. pigment blue 15, C.I. pigment blue 15:2, C.I. pigment blue 15:3, C.I. pigment blue 16, C.I. pigment blue 60, C.I. pigment green 7.

Examples of the colorant include C.I. solvent red 1, C.I. solvent red 49, C.I. solvent red 52, C.I. solvent red 58, C.I. solvent red 63, C.I. solvent red 111, C.I. solvent red 122, C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. solvent yellow 162, C.I. solvent blue 25, C.I. solvent blue 36, C.I. solvent blue 60, C.I. solvent blue 70, C.I. solvent blue 93, C.I. solvent blue 95 and the like. Mixtures of these may also be used.

These organic pigments may be used singly, or multiple organic pigments may be selected and used together. In addition, the amount of the pigment added is preferably 2-20 percent by mass with respect to the polymers, and more preferably 3-15 percent by mass.

(Wax)

In the polymer toner, wax may be included in the toner particles. The structure and composition of the wax itself is not specifically limited. Low molecular weight polyolefin waxes such as polypropylene and polyethylene, paraffin wax, Fischer-Tropsch wax and ester wax may be used.

The addition amount is preferably 1-30 percent by mass of the total amount of toner, and more preferably 2-20 percent by mass, and still more preferably 3-15 percent by mass.

The toner which is useable in image formation using the developing roller of the present invention is preferably one in which wax is dissolved in the monomer and dispersed in water to perform polymerization and form particles in which wax included in the resin particles, and then this is salted out and fused along with the colorant particles to form the toner.

(Toner Manufacturing Method)

The toner of the present invention is preferably manufactured by a polymerization method comprising: a step of dispersing a monomer solution into which wax has been dissolved into a water based medium and then preparing resin particles which include a release agent using a polymerization method; a step of fusing the resin particles in the water based medium using the resin particle dispersant; a washing step for filtering the obtained particles from the water based medium and removing the surfactant and the like; a step for drying the obtained particles; an external additive step for adding an external additive and the like to the obtained particles that have been dried. The resin particle herein may also be colored particles. In addition, uncolored particles may also be used as the resin particles and in this case, colored particles may be obtained by adding colorant particle dispersion solution to the resin particle dispersion solution and then fusing them in them in the water based medium.

In particular, the method for fusing is preferably one in which the resin particles created by the polymerization steps are used for salting out/fusing. In addition, in the case where uncolored resin particles are used, the resin particles and the colorant particles may be salted out/fused in the water based medium.

The additives are not limited to colorants and releasing agents and charge control agents which are required for toner structure may also be added as particles in this step.

It is to be noted that because the water based medium refers to a substance with water as its main component, the water content is 50 percent by mass or more. Substances other than water that are included, are organic solvents which can dissolve in water and examples include methanol, ethanol, isopropanol, butanol, acetone, methyl ethyl ketone, tetrahydrofuran and the like.

The preferable polymerization method of the present invention is a method in which a radical is polymerized by adding a water-soluble polymerization initiation agent into a dispersion solution in which oil droplets are dispersed using mechanical energy into a water based medium in which a surfactant whose with lower critical micelle concentration is dissolved monomer solution having a release agent dissolved in the monomer.

The disperser for performing oil drop dispersion is not specifically limited, but examples include clear mix, ultrasonic disperser, mechanical homogenizer, Manton Gaulin homogenizer and a pressure type homogenizer and the like.

As is the case above, the surface of the colorant itself may be modified and used. The method for reforming the surface of the colorant is one in which the colorant is dispersed in a solvent and surface modifier is added to the resulting solution and then reacted by increasing the temperature. After the reaction is complete, filtration is done and washing filtration is repeated using the same solvent and drying is done to obtain a pigment that has been processed using a surface modifier.

The method for preparing the colorant particles may be one in which the colorant is dispersed in a water based medium. The dispersion is performed in a state in which the concentration of the surfactant in the water is greater than the critical micelle concentration (CMC).

The disperser used at the time of pigment dispersion is not specifically limited, but preferable examples include solvent type dispersers such as clear mix, ultrasonic disperser, mechanical homogenizer, Manton Gaulin homogenizer and a pressure type homogenizer, Getman mill, diamond fine mill and the like.

The surfactant used here may be the surfactants listed above.

The salting out/fusion step is the step in which a salting out agent formed from alkali metal salt or an alkali earth metal is added as the coagulating agent with a concentration greater than the critical coagulating concentration, to water in which resin particles and colorant particles are present and then salting out progresses and fusion is performed simultaneously as a result of heating the resin particles above the glass transition temperature.

Examples of the alkali metal salt and alkali earth metal which form the salting out agent include lithium, potassium, sodium and the like for the alkali metal salt, and magnesium, calcium, strontium, barium and the like for the alkali earth metal and potassium, sodium, magnesium, calcium and barium are preferable. In addition, examples of the substance comprising the salt include chlorine salts, bromine salts, iodine salts, carbonate salts, sulfate salts.

(Other Additives)

Other materials other than resin, colorant, releasing agent, which can impart various functions may be added as toner material. A specific example is charge control agents. These components may be added by various methods including a method in which they are added at the same time as the resin particles and the colorant particles in the salting out/fusion stage; a method of including them in the toner; and a method of adding them to the resin particles themselves.

The charge control may also be any that is known and which can be dispersed in water. Specific examples include nigrosine based colorants, naphtenic acid or metal compound of higher fatty acid, alkoxylated amine, quaternary ammonium salts, azo-based metal complexes, salicylic acid metal salts or metal complexes thereof.

(External Additives)

So-called external additives may be added to the toner of the present invention in order to improve charging properties and cleaning properties. These external additives are not specifically limited and various inorganic particles, inorganic particles and lubricants may be used. It is to be noted that the particles prior to the addition of these external agents are often called colorant particles while they are called toner or toner particles after the addition of these external additives.

The inorganic particles known heretofore can be used. Specifically silica, titanium, aluminum particles and the like having number average primary particle diameter of 5-500 nm are preferably used.

Specific examples of the silica particles include commercial products R-805, R-976, R-974, R-972, R-812 and R-809 manufactured by Japan Aerosil; HVK-2150 and H-200 manufactured by Hoechst, and commercial products TS-720, TS-530, TS-610, H-5, MS-5 and the like.

Examples of the titanium particles include commercial products T-805 and T-604 manufactured by Japan Aerosil and commercial products MT-100S, MT-100B, MT-500BS, MT-600, MT-600SS, and JA-1 manufactured by Teika, TA-300SI, TA-500, TAF-130, TAF-510, TAF-510T manufactured by Fuji-Titanium, and commercial products IT-S, IT-OA, IT-OB, IT-OC manufactured by Idemitsu Kosan.

Examples of the alumina particles include commercial products RFY-C and C-604 manufactured by Japan Aerosil and commercial product TTO-55 manufactured by Ishihara Industries.

In addition, the organic particles used are spherical organic particles having a number average primary particle diameter of 10-2000 nm. Examples include monomers of styrene methyl methacrylate or copolymers thereof.

Examples of the lubricant include metal salts of higher fatty acids such as: salts of zinc, aluminum, copper, magnesium and calcium salts of stearic acid; zinc, manganese, iron, copper and magnesium salts of oleic acid; zinc, copper, magnesium and calcium salts of palmitic acid; zinc and calcium salts linolic acid; zinc and calcium salts of ricinoleic acid and the like.

The addition amount for these additives is preferably 0.1-5 percent by mass to the amount of toner.

The external additive is added by using a known mixing apparatus such as a tabular mixer, a HENSCHEL MIXER, a Nauter mixer, a V-type mixer.

In the present invention, the median diameter ($D_{50}$) in the volume standard that is prepared by the polymerization method is preferably 3-9 μm in view of obtaining high quality toner images.

Next, the developing apparatus and the full color image forming apparatus of the present invention will be described.

Figure 3:
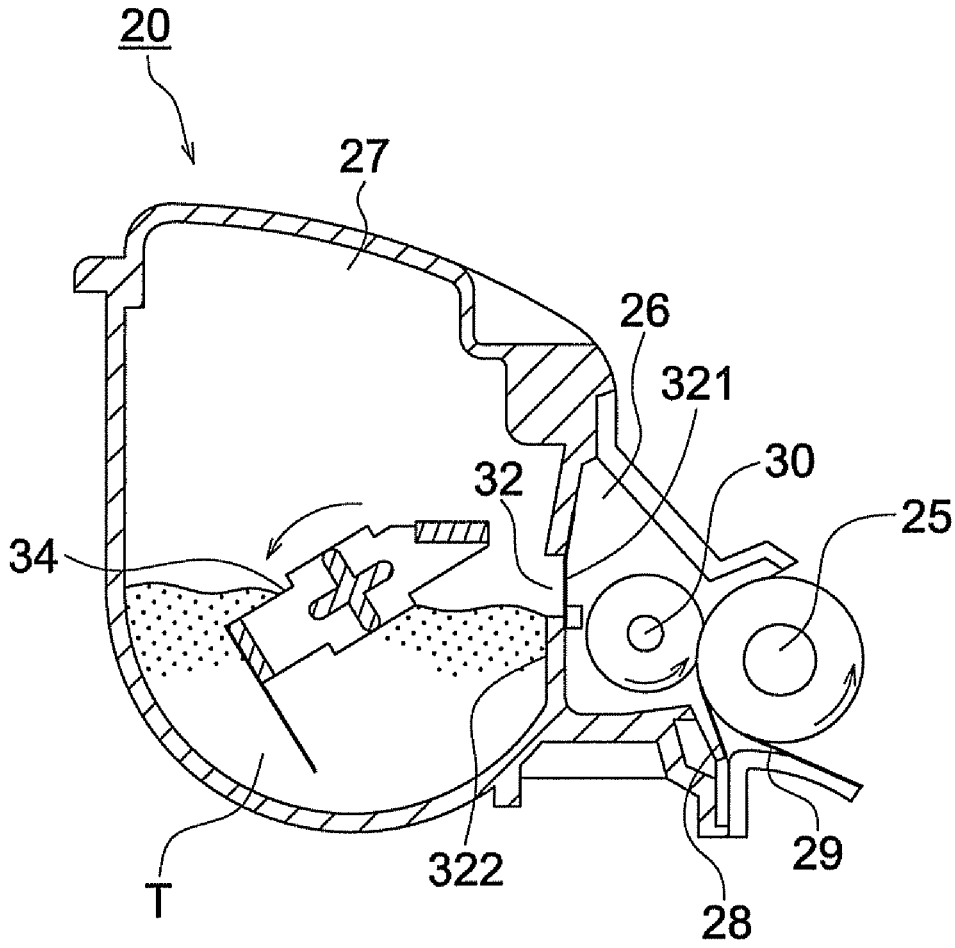
FIG. 3 is a schematic cross-sectional view showing an example of the developing roller of the present invention.

FIG. 3 is a cross-sectional schematic view showing an example of the developing apparatus of the present invention.

The developing apparatus 20 in FIG. 3 comprises a buffer chamber 26 which is adjacent to the developing roller 25 and a hopper 27 which is adjacent to the buffer chamber 26.

The blade 28 which is the toner controlling member is arranged in the buffer chamber 26 in a state of pressure contact with the developing roller 25. The blade 28 controls the charge amount and the amount of toner applied to the developing roller 25. At the downstream side of the blade 28 with respect to the direction of rotation of the developing roller 25, there is also an auxiliary blade 29 for assisting with control of charge amount and application amount on the developing roller 25.

The developing roller 25 is pressed onto the supply roller 30. The supply roller 30 is rotated so to be driven in the same direction as the developing roller (anticlockwise direction in FIG. 3) by a motor that is not shown. The supply roller comprises a conductive cylindrical base and a foam layer which is formed on the outer circumference of the base of polyurethane foam or the like.

The toner T which is a non-magnetic one-component developer is stored in the hopper 27. The hopper 27 has a rotating member 34 for agitating the toner T. A film-like conveyance wing is mounted on the rotating member 34, and toner is conveyed by rotation of the rotating member 34 in the direction of the arrow. The toner that is conveyed by the conveyance wing is supplied to the buffer chamber 26 via the path 32 that is provided in the partition wall that partitions the hopper 27 and the buffer chamber 26. It is to be noted that the configuration of the conveying wing is such that it bends while the toner T is conveyed at the front of the rotation direction of the wing as the rotation body 34 rotates and also returns to a perfectly straight shape when it reaches the left side end of path 32. Because the wing returns immediately to its shape via the bent configuration, the toner T is supplied to the path 32.

In addition, path 32 has a valve 321 which closes the path 32. The valve is formed of a film-like member and one end is fixed to the upper side of the left side surface of the path 32 and when the toner T is supplied from the hopper 27 to the path 32, the left side is pressed by the pressing force from the toner T and the path 32 is thereby opened. As a result, the toner T is supplied inside the buffer chamber 26.

In addition, a control member 322 is mounted to the other side of the valve 321. The control member 322 and the supply roller 30 are arranged so as to form a small interval even in the state where the valve 321 closes the path 32. The control member 322 performs adjustment such that the amount of toner collecting at the bottom portion of the buffer chamber 26 does not become excessive and thus the toner T that collects on the supply roller 30 from the developing roller 25 is adjusted so that large amounts do not fall to the bottom portion of the buffer chamber 26.

At the developing roller 20, the developing roller 25 is driven so as to rotate in the direction of the arrow at the time of image formation and the toner in the buffer chamber 26 is supplied onto the developing roller 25 by rotation of the supply roller. The toner T supplied onto the developing roller 25 is charged and formed into a thin layer by the blade 28 and the auxiliary blade 29 and then conveyed to the region opposite to the image carrier and then supplied for development of the latent image on the image carrier. The toner that is not used in development is returned to the buffer chamber 26 as the developing roller 25 rotates and it is scraped from the developing roller 25 by the supply roller 30 and thereby collected.

Figure 4:
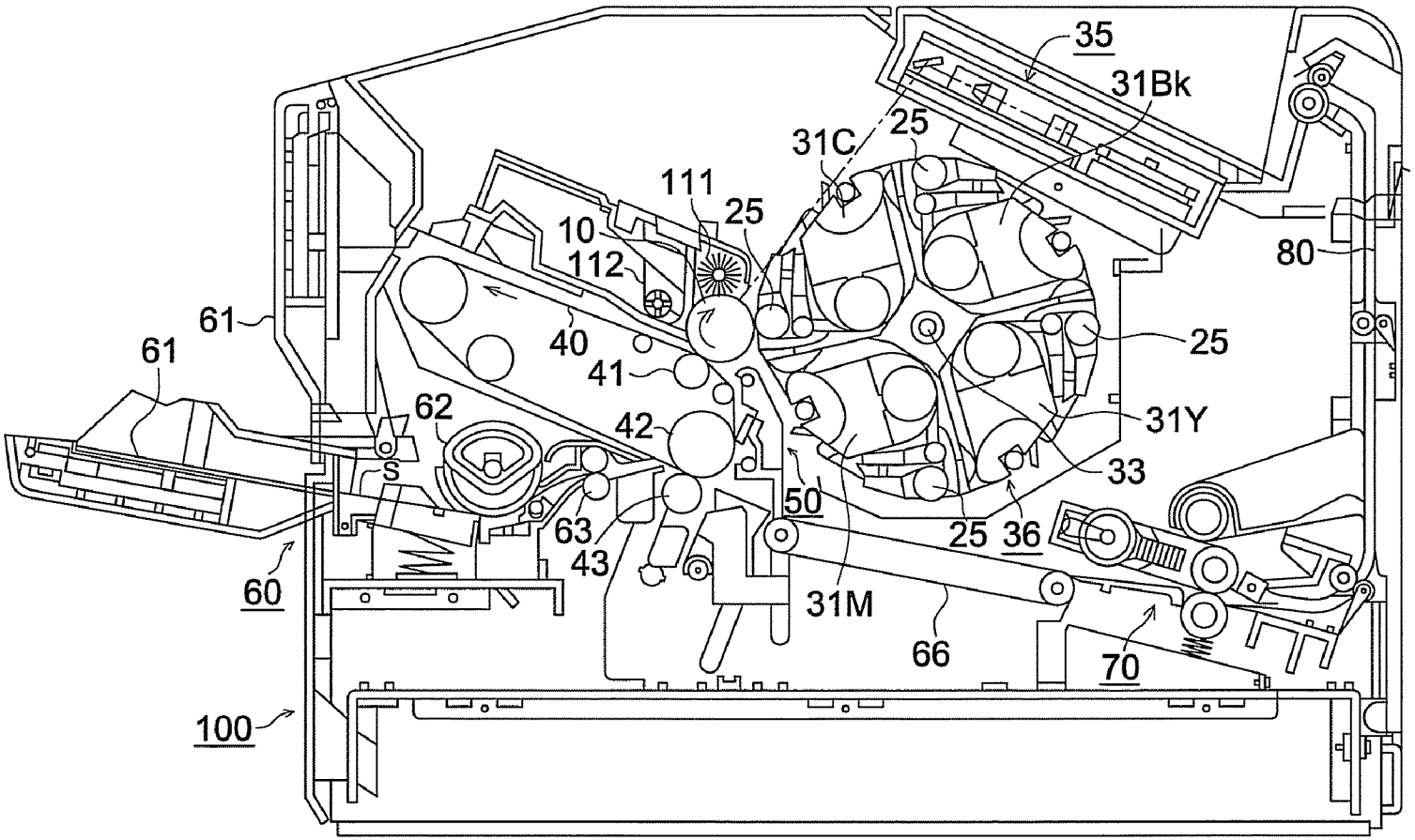
FIG. 4 is a schematic cross-sectional view showing an example of the full color image forming apparatus.

FIG. 4 is a schematic cross-sectional view showing an example of the full color image forming apparatus.

In the full color image forming apparatus shown in FIG. 4, a charging brush that charges the surface of the photoreceptor drum 10 is provided on the periphery of the photoreceptor drum 10 that is driven so as to rotate.

The photoreceptor drum 10 that is charged by the charging brush 111 has a laser scanning optical system 35 which performs scanning and exposure using a laser beam. The laser scanning optical system 35 may be any known optical system with built-in laser diode, polygon mirror and fθ optical element, and the control section thereof transfers printing data for each of the colors yellow, magenta, cyan, and black from a host computer. The laser scanning optical system 35 then sequentially outputs laser beams based on the printing data for each of the above colors and the photoreceptor drum 10 is scanned and exposed and as a result, electrostatic latent images of each color are sequentially formed on the photoreceptor drum 10.

In addition, the full color developing apparatus 36 which supplies toner of each of the colors to the photoreceptor drum 10 on which these electrostatic latent images are formed and which performs full color development has developing devices 31Y, 31M, 31C and 31Bk of 4 different colors in which non-magnetic one-component toner of each of the colors yellow, magenta, cyan, and black are stored, on the periphery of the support shaft 33, and they rotate about the support shaft 33 and each of the developing devices 31Y, 31M, 31C and 31Bk are led to a position facing the photoreceptor drum 10.

In addition, in each of the developing devices 31Y, 31M, 31C and 31Bk in the full color developing apparatus 36, as shown in FIG. 4, the toner controlling member is press-contacted onto the peripheral surface of the developer carrier (developing roller) 25 which rotates and conveys the toner and the amount of toner conveyed by the developing roller 25 is controlled by this toner controlling member and the conveyed toner is also charged thereby. It is to be noted that the full color developing apparatus 36 may have two toner controlling members in order to suitably perform control of toner conveyed by the developing roller as well as to suitably perform charging.

As described above, each time the electrostatic latent images of each of the colors is formed on the photoreceptor drum using the laser scanning optical system 35, the full color developing apparatus 36 is rotated around the support shaft 33 as described above and the developing devices 31Y, 31M, 31C and 31Bk in which the toner of the corresponding color is stored are successively led to the position facing the photoreceptor 10 and the developing roller 25 in the developing devices 31Y, 31M, 31C and 31Bk successively supplies charged toner of each color toward the photoreceptor drum on which electrostatic latent images of the respective colors are formed as described above and development is performed.

An endless type intermediate transfer belt 40 which is driven so as to rotate is provided as the intermediate transfer member 40 further in the rotation direction downstream side of the photoreceptor drum than the full color developing apparatus 36. The intermediate transfer belt 40 is driven so as to rotate synchronously with the photoreceptor drum 10. In addition, the intermediate transfer belt 40 is pressed by the rotatable primary transfer roller 41 so as to come in contact with the photoreceptor drum 10. Also a secondary transfer roller 43 is provided so as to be rotatable at the portion of the support roller 42 which supports the intermediate transfer belt 40 and recording material S such as a recording sheet and the like is pressed to the intermediate transfer belt 40 by the secondary transfer roller 43.

Furthermore a cleaner 50 which removes residual toner on the intermediate transfer belt 40 is provided in the space between the full color developing apparatus 36 and the intermediate transfer belt 40 so as to capable of making contact with and separating from the intermediate transfer belt 40.

The sheet feeding means 60 which leads recording material S such as regular paper and the like to the intermediate transfer belt 40 comprises a sheet feeding tray 61 for storing the recording material S; a sheet feeding roller 62 for feeding the recording material S stored in the sheet feeding tray 61, one sheet at a time; a timing roller 63 which sends the recording material S which is fed synchronously with the images formed in the intermediate transfer belt 40 between the intermediate transfer belt 40 and the secondary transfer roller 43, and in this manner, the recording material S that is sent between the intermediate transfer belt 40 and the secondary transfer roller 43 is pressed to the intermediate transfer belt 40 by the secondary transfer roller 43 and the toner image from the intermediate transfer belt 40 is transferred by pressing to the recording material S.

Meanwhile, the recording material S onto which the toner image is transferred by pressing as described above is led to the fixing apparatus 70 by the conveyance means 66 that is formed of an air suction belt and the like, and in the fixing apparatus 70, the transferred toner image is fixed on the recording material S, and then the recording material S is ejected onto the upper surface of the apparatus main body 100 via the vertical conveyance path 80.

Next, the operation of performing full color image formation using the full color image forming apparatus will be described more specifically.

First, the photoreceptor drum 10 and the intermediate transfer belt 40 are driven so as to be rotated in the respective directions at the same peripheral velocity and the photoreceptor drum 10 is charged to a prescribed potential by the charging brush 11.

In addition, yellow image exposure is performed for this charged photoreceptor drum 10 by the laser scanning optical system 35 and electrostatic latent images for the yellow images are formed on the photoreceptor drum 10 and then as described above, yellow toner charged by the toner controlling member is supplied from the developing device 31Y in which the yellow toner is stored, to the photoreceptor drum 10 and the yellow images are developed. The intermediate transfer belt 40 is pressed onto the photoreceptor drum 10 on which the yellow toner images have been formed in this manner by the primary roller 41, and the yellow toner images formed on the photoreceptor drum 10 is primarily transferred to the intermediate transfer belt 40.

After the yellow toner image is transferred to the intermediate transfer belt 40 in this manner, as described above, the full color developing apparatus 36 is rotated around the support shaft 33 and the developing device 31M in which the magenta toner is stored is led to the position facing the photoreceptor drum 10, and as is the case for yellow images, magenta image exposure is performed for this charged photoreceptor drum 10 by the laser scanning optical system 35 and electrostatic latent images are formed, and the electrostatic latent images are developed by the developing apparatus 31 in which magenta toner is stored and the developed magenta toner image is subjected to primary transfer from the photoreceptor drum 10 to the intermediate transfer belt 40. In addition, exposure, development, and primary transfer of cyan images and black images are performed sequentially in the same manner and yellow, magenta, cyan and black toner images are sequentially superposed on the intermediate transfer belt 40 to form full color toner images.

When the last black toner image is subjected to primary transfer to the intermediate transfer belt 40, the recording material S is sent between the secondary transfer roller 43 and the intermediate transfer belt 40 by the timing roller 63 and the recording material S is pressed to the intermediate transfer belt 40 by the secondary transfer roller 43 and the full color toner image formed on the intermediate transfer belt 40 is subjected to secondary transfer onto the recording material S.

In addition, when the full color toner image is subjected to secondary transfer to the recording material S in this manner, the recording material S is led to the fixing apparatus 70 by the conveyance means 66 and the full color toner images that were transferred by the fixing apparatus 70 are fixed on recording material S, and subsequently, ejected onto the upper surface of the apparatus main body 100 via the vertical conveyance path 80.

EXAMPLES

The present invention is described in detail using examples, however, the present invention is not limited thereto.

Manufacturing of Developing Roller

The developing roller is manufactured by the following steps.

<<Shaft Preparation>>

The shaft is prepared by using an aluminum alloy which includes the metal elements shown in Table 1 to make hollow cylindrical tube with external diameters and thicknesses shown in Tables 1 and 2 and flanges are mounted at the ends of the hollow cylindrical tubes. These are designated as shafts 1-31.

<Preparation of Coating Liquid for Coating Layer Formation>

(Preparation of Coating Liquid 1 for Coating Layer Formation)

One hundred parts by mass of the siloxane modified urethane resin in which the Si content by silica weight conversion is 6.0 percent by mass (hereafter referred to as urethane resin), the urethane resin being obtained by a method described in JP-A No. 2002-220431 and also summarized below, was dissolved in a mixed solvent of 400 parts by mass of methylethyl ketone and 300 parts by mass of isopropyl alcohol. Thirty parts by mass of carbon black (bulk resistivity: $1\times10^{-1}$ Ω·cm, number average primary particle diameter: 50 nm), 1.0 part by mass of tetramethylammonium chloride and 20 parts by mass of cross-linked urethane resin particles with a number median diameter ($D_{50}$) of 20 μm are mixed and dispersed in the above resultant solution and "coating liquid 1 for coating layer formation" is thereby prepared.

(Preparation of Siloxane Modified Urethane Resin (Si Content by Silica Weight Conversion is 6.0 Percent by Mass))

In a reaction vessel equipped with an agitator, a thermometer and an inlet tube for nitrogen gas, 1000 g of polyester polyol (Kuraray Polyol P2010 having number average molecular weight of 2000, produced by Kuraray Co., Ltd.) and 278 g of isophorone diisocyanate were charged and reacted at 100° C. for 6 hours under a nitrogen gas stream to obtain a prepolymer having the free isocyanate value of 3.44%. Further, 548 g of methylethyl ketone was added to form a homogeneous solution of urethane prepolymer. Then, 1000 g of the above urethane prepolymer solution was added to a mixture of 71.8 g of isophorone diamine, 4.0 g of di-n-butylamine, 906 g of methyethyl ketone and 603 g of isopropyl alcohol, followed by reacting at 50° C. for 3 hours to obtain a solution of polyurethane resin (hereafter referred to as polyurethane resin (1A)). The solid content of polyurethane resin (1A) was 30% and the amine value was 1.2 KOHmg/g. Further, in a similar reaction vessel, 500 g of polyurethane resin (1A) was charged and heated to 50° C., then, 17.75 g of epoxy group containing-alkoxysilane partial condensate (2A) as described in the following "manufacturing example 1" was added and reacted at 60° C. for 4 hours to obtain an alkoxy group containing-silane modified polyurethane resin. The ratio of (equivalent of epoxy group in epoxy containing-alkoxysilane partial condensate (2A))/(equivalent of amino group in polyurethane resin (1A)) was 2, and the Si content by silica weight conversion in the alkoxy group containing-silane modified polyurethane resin was 6.0%.

(Manufacturing Example 1)

In a reaction vessel equipped with an agitator, a distillation tube, a thermometer and an inlet tube for nitrogen gas, 250.0 g of glycidol and 2675.4 g of tetramethoxysilane partial condensate (Methylsilicate 56 having 10 Si atom in an average, produced by Tama Chemicals Co., Ltd.) were charged and heated to 90° C. while agitating under a nitrogen stream to react using 0.5 g of dibutyltin dilaulate as a catalyst. While the reaction, methanol was removed by distillation and, when the amount of methanol reached 125 g, the reaction system was cooled down. The duration from start heating to cooling down was 6.5 hours. Then, 5 g of residual methanol in the system was removed by vacuum distillation at 13 kPa for 10 minutes. Thus, epoxy group containing-alkoxysilane partial condensate (2A) was obtained. The ratio of (equivalent of hydroxyl group in the epoxy compound)/(equivalent of alkoxy group in the alkoxysilane condensate) was 0.05 and the equivalent of epoxy was 830 g/eq, at the initial stage of charging materials.

(Preparation of Coating Liquid 2 for Coating Layer Formation)

Forty parts by mass of carbon black (bulk resistivity $1\times10^{-1}$ Ω·cm, number average primary particle diameter 50 nm), 5.0 parts by mass of benzyltrimethylammonium chloride, and 30 parts by mass of cross-linked acrylic resin particles with a number average median diameter ($D_{50}$) of 20 μm were dispersed for 2 hours using a sand mill in a solution in which 100 parts by mass of an acrylic resin (Sumipex LG manufactured by Sumitomo Chemicals is dissolved in 700 parts by mass of methylethyl ketone to obtain "coating liquid 2 for coating layer formation".

(Preparation of Coating Liquid 3 for Coating Layer Formation)

40 parts by mass of carbon black (weight specific resistivity $1\times10^{-1}$Ω·cm, number average primary particle diameter 50 nm), 3.0 parts by mass of benzyl trimethyl ammonium chloride, and 10 parts by mass of cross-linked acrylic resin particles with a number average median diameter ($D_{50}$) of 20 μm were dispersed for 2 hours using a sand mill into a solution in which 100 parts by mass of a polyamide resin (Tresin MF-30 manufactured by Nagano Chemtex is dissolved in a mixture of 400 parts by mass of methanol and 300 parts by mass of 1-butanol, and the "coating liquid 3 for coating layer formation" was thereby prepared.

<<Production of Developing Roller 1>>

(Formation of Coating Layer)

The outer peripheral surface of the "shaft 1" was spray-coated with the "coating liquid 1 for coating layer formation" and then dried for 1 hour at 120° C. such that a coating layer having a film thickness of 15 μm after drying was formed, and the "developing roller 1" was thereby prepared.

<<Production of Developing Rollers 2-31>>

"Developing rollers 2-31" were produced in the same manner as developing roller 1 except that "Shaft 1" and "coating liquid 1 for coating layer formation" used in producing the developing roller 1 were replaced with the shafts and the coating liquids for coating layer formation shown in Tables 1 and 2.

Tables 1 and 2 show the outer diameter and thickness of the prepared shaft, the elements included and their amounts and the coating liquid for coating layer formation number.

TABLE 1

| | Shaft | | | | | | | |
|---|---|---|---|---|---|---|---|---|
| | | | | Elements included | | | | Coating |
| Developing roller No. | No. | Outer diameter (mm) | Thickness (mm) | Si (percent by mass) | Mn (percent by mass) | Mg (percent by mass) | Cr (percent by mass) | solution for coating layer formation No. |
| **1 | Shaft 1 | 16 | 1 | 0.25 | 0.10 | 2.20 | 0.15 | A |
| **2 | Shaft 2 | 4 | 1 | 0.25 | 0.10 | 2.20 | 0.35 | A |
| **3 | Shaft 3 | 5.5 | 1 | 0.25 | 0.10 | 2.20 | 0.35 | A |
| **4 | Shaft 4 | 16 | 1 | 0.25 | 0.10 | 2.20 | 0.35 | A |
| **5 | Shaft 5 | 28 | 1 | 0.25 | 0.10 | 2.20 | 0.35 | A |
| **6 | Shaft 6 | 32 | 1.5 | 0.25 | 0.10 | 2.20 | 0.35 | A |
| **7 | Shaft 7 | 16 | 1 | 0.30 | 0.20 | 6.00 | 0.05 | A |
| **8 | Shaft 8 | 16 | 1 | 0.25 | 0.10 | 2.20 | 0.15 | B |
| **9 | Shaft 9 | 16 | 1 | 0.25 | 0.10 | 2.20 | 0.05 | B |
| **10 | Shaft 10 | 16 | 1 | 0.30 | 0.20 | 5.60 | 0.35 | B |
| **11 | Shaft 11 | 16 | 1 | 0.30 | 0.05 | 0.05 | 0.00 | A |
| **12 | Shaft 12 | 16 | 1 | 0.60 | 1.50 | 0.00 | 0.00 | A |
| **13 | Shaft 13 | 16 | 1 | 0.80 | 0.15 | 1.20 | 0.04 | A |
| **14 | Shaft 14 | 16 | 1 | 0.20 | 0.10 | 0.40 | 0.35 | A |
| **15 | Shaft 15 | 16 | 1 | 0.20 | 0.10 | 0.40 | 0.35 | C |

**Developing roller

A: Coating liquid 1 for coating layer formation

B: Coating liquid 2 for coating layer formation

C: Coating liquid 3 for coating layer formation

TABLE 2

| | Shaft | | | | | | | |
|---|---|---|---|---|---|---|---|---|
| | | | | Elements included | | | | Coating |
| Developing roller No. | No. | Outer diameter (mm) | Thickness (mm) | Si (percent by mass) | Mn (percent by mass) | Mg (percent by mass) | Cr (percent by mass) | solution for coating layer formation No. |
| **16 | Shaft 16 | 16 | 1 | 0.20 | 0.05 | 2.20 | 0.35 | A |
| **17 | Shaft 17 | 16 | 1 | 0.20 | 1.50 | 2.20 | 0.35 | A |
| **18 | Shaft 18 | 16 | 1 | 0.80 | 0.05 | 2.20 | 0.35 | A |
| **19 | Shaft 19 | 16 | 1 | 0.80 | 1.50 | 2.20 | 0.35 | A |
| **20 | Shaft 20 | 16 | 1 | 0.10 | 0.03 | 0.00 | 0.00 | A |
| **21 | Shaft 21 | 16 | 1 | 0.10 | 0.02 | 0.30 | 0.02 | A |
| **22 | Shaft 22 | 16 | 1 | 1.00 | 0.16 | 6.20 | 0.00 | B |
| **23 | Shaft 23 | 16 | 1 | 0.90 | 0.18 | 5.80 | 0.40 | B |
| **24 | Shaft 24 | 16 | 1 | 0.20 | 0.04 | 2.20 | 0.35 | A |
| **25 | Shaft 25 | 16 | 1 | 0.20 | 1.60 | 2.20 | 0.35 | A |
| **26 | Shaft 26 | 16 | 1 | 0.80 | 0.04 | 2.20 | 0.35 | A |
| **27 | Shaft 27 | 16 | 1 | 0.80 | 1.60 | 2.20 | 0.35 | A |
| **28 | Shaft 28 | 16 | 1 | 0.19 | 0.05 | 2.20 | 0.35 | A |
| **29 | Shaft 29 | 16 | 1 | 0.19 | 1.50 | 2.20 | 0.35 | A |
| **30 | Shaft 30 | 16 | 1 | 0.81 | 0.05 | 2.20 | 0.35 | A |
| **31 | Shaft 31 | 16 | 1 | 0.81 | 1.50 | 2.20 | 0.35 | A |

**Developing roller

A: Coating liquid 1 for coating layer formation

B: Coating liquid 2 for coating layer formation

C: Coating liquid 3 for coating layer formation

Toner Preparation (Non-Magnetic One Component Developer)

The toner is prepared using the following procedure.

(1) Preparation of "Resin Particle Dispersant 1"

In a flask equipped with an agitating device, 72.0 parts by mass of pentaernthritol tetrastearate ester was added to a monomer mixture of 115.1 parts by mass of styrene, 42.0 parts by mass of n-butyl acrylate 42.0 and 10.9 parts by mass of methacrylic acid and dissolved by being heated to 80° C.

On the other hand, a surfactant solution in which 7.08 parts by mass of an anionic surfactant (sodium dodecyl benzene sulfonate: SDS) was dissolved in 2760 parts by mass of ion exchanged water was loaded in a separable flask equipped with an agitating device, a thermometer sensor, a cooling tube and a nitrogen induction device and heated to 80° C. while being agitated at an agitation speed of 230 rpm under a nitrogen flow. Next, the monomer solution (80° C.) was mixed with and dispersed in the surfactant solution (80° C.) by a mechanical disperser (clear mix manufactured by M Technique Co., Ltd.) to prepare an emulsion in which emulsified particles (oil droplets) having uniform dispersed particle diameter were dispersed.

An initiator solution in which 0.84 parts by mass of a polymerization initiator (potassium persulfate: KPS) was dissolved in 200 parts by mass of ion exchanged water was added to the dispersion solution, and this system was heated and agitated for 3 hours at 80° C. to carry out a polymerization reaction. A solution in which 7.73 parts by mass of polymerization initiator (KPS) was dissolved in 240 parts by mass of ion exchanged water was added to the obtained reaction solution and after 15 minutes when the resultant was heated to 80° C., a mixture of 383.6 parts by mass of styrene, 140.0 parts by mass of n-butyl acrylate, 36.4 parts by mass of methacrylic acid and 12 parts by mass of n-octylmercaptan was added by dropping over a period of 100 minutes, and this system was heated and agitated for 60 minutes at 80° C. and then cooling to 40° C. Thus, the "resin particle dispersion solution 1" including wax (hereafter, referred to as "latex (1)") was obtained.

(2) Preparation of the Colorant Dispersion Liquid Bk

In 160 parts by mass of ion exchanged water, 9.2 parts by mass of sodium n-dodecyl sulfate was dissolved and agitated. Then, 20 parts by mass of carbon black (Mogal L manufactured by Cabot Corp.) was gradually added as the colorant while agitating the solution and then by performing dispersion processing using "clear mix manufactured by M Technique Co., Ltd.)" Thus, the "colorant dispersion solution Bk" was obtained. The particle diameter of the colorant particles in the "colorant dispersion solution Bk" were measured by Electrophoretic Light Scattering Spectrophotometer (ELS-800 (Otsuka Electronics Co., Ltd.), and the weight average particle diameter was 120 nm.

(3) Preparation of Colorant Particles 1Bk

In a reaction vessel (a 4-necked flask) equipped with a temperature sensor, a cooling tube, an agitation device (with 2 agitation blades of which a cross-angle was 20°), and a shape monitoring device, 1250 parts by mass of "resin particle dispersion solution 1" (solid content conversion), 2000 parts by mass of ion exchanged water and all of the "colorant dispersion solution 1" were charged, and after the internal temperature was adjusted to 25° C., 5 mol/liter of sodium hydroxide solution was added to the dispersion solution mixture to adjust the pH to 10.0. Next, a solution in which 52.6 parts by mass of magnesium chloride-6 hydrate is dissolved in 72 parts by mass of ion exchanged water, was added over 10 minutes at 25° C. while agitating. Immediately after that, heating was started and the system was heated to 95° C. over 5 minutes (heating rate 14° C./minute).

In this state, the particle diameter of the composite is measured using "Multisizer 3 (manufactured by Beckman Coulter)" and at the point when the volume media diameter ($D_{50}$) was 6.5 μm, an aqueous solution in which 115 parts by mass of sodium chloride was dissolved in 700 parts by mass of ion exchanged water was added to stop the particle growth. Furthermore, heating and agitation (agitation rotation frequency 120 rpm) was performed for 8 hours at a solution temperature of 90° C. and fusion was continued, and after the aging process, the system was cooled to 30° C. at 10° C./minute and hydrochloric acid is added to adjust pH to 3.0, then, agitation was stopped.

The particles produced were filtered and repeatedly washed in ion exchanged water and then subjected to in-solution classification processing using a centrifugal separator and subsequently the drying process was performed using a flash jet dryer and "colorant particles 1Bk" having a water content of 1.0 mass % were thus produced.

(4) Preparation of "Colorant Dispersion Solution Y"

"Colorant dispersion solution Y" was prepared using the same procedure as in the preparation of "colorant dispersion solution Bk" except that 20 parts by mass of "C.I. Pigment Yellow 74" is used instead of 20 parts by mass of carbon black. The particle diameter of the colorant particles in the "colorant dispersion solution Y" were measured by an Electrophoretic Light Scattering Spectrophotometer (ELS-800, produced by Otsuka Electronics Co., Ltd), and the weight average particle diameter was found to be 120 nm.

(5) Preparation of "Colorant Dispersion Solution M"

"Colorant dispersion solution M" was prepared using the same procedure as in the preparation of "colorant dispersion solution Bk" except that 20 parts by mass of quinacridone based magenta pigment "C.I. Pigment red 122" was used instead of 20 parts by mass of carbon black. The particle diameter of the colorant particles in the "colorant dispersion solution M" were measured by an Electrophoretic Light Scattering Spectrophotometer (ELS-800, produced by Otsuka Electronics Co., Ltd), and the weight average particle diameter was found to be 120 nm.

(6) Preparation of "Colorant Dispersion Solution C"

"Colorant dispersion solution C" was prepared using the same procedure as in the preparation of "colorant dispersion solution Bk" except that 20 parts by mass of phthalocyanine based cyan pigment "C.I. Pigment blue 15:3" was used instead of 20 parts by mass of carbon black. The particle diameter of the colorant particles in the "colorant dispersion solution C" were measured by an Electrophoretic Light Scattering Spectrophotometer (ELS-800, produced by Otsuka Electronics Co., Ltd), and the weight average particle diameter was found to be 120 nm.

(7) Preparation of "Colored Particles 1Y"

The "colored particles 1Y" were prepared by the same procedure as in the preparation of the "colored particles 1Bk" except that the total amount of the "colorant dispersion solution Bk" was replaced with the total amount of the "colorant dispersion solution Y".

(8) Preparation of "Colored Particles 1M"

The "colored particles 1M" were prepared by the same procedure as in the preparation of the "colored particles 1Bk" except that the total amount of the "colorant dispersion solution Bk" was replaced with the total amount of the "colorant dispersion solution M".

(9) Preparation of "Colored Particles 1C"

The "colored particles" 1C were prepared by the same procedure as in the preparation of the "colored particles 1Bk" except that the total amount of the "colorant dispersion solution Bk" was replaced with the total amount of the "colorant dispersion solution C".

(10) Preparation of the Toner

To each type of the abovementioned colored particles, 0.8 parts by mass of hydrophobic silica having number average primary particle diameter of 12 nm and hydrophobicity level of 65 and 0.5 part by mass of hydrophobic titania having number average primary particle diameter of 30 nm and hydrophobicity level o 55 were added and mixed in a HENSCHEL MIXER to thereby prepare the toner. These are designated as "toner 1Bk, toner 1Y, toner 1M and toner 1C".

<Interlayer Adhesive Strength>

The interlayer adhesive strength between the shaft and the coating layer of the developing roller produced above is measured by the foregoing method and evaluated based on the following criteria.

Evaluation Criteria

Developing roller in which the load at which peeling off begins is 10.0 N or more is in a satisfactory level.

Developing roller in which the load at which peeling off begins is 4.0N or more and less than 10.0 N is in a practically acceptable level.

Developing roller in which the load at which peeling off begins is less than 4.0 N is in a practically unacceptable level.

<<Evaluation>>

The evaluation of the developing roller was performed by modifying the color printer "Magicolor 2430 DL (Manufactured by Konica Minolta Business Technologies, Inc.)" such that image formation can be performed using a developing device in which the developing roller produced above is installed. Non-magnetic one-component developers of four colors (toner 1Bk, toner 1Y, toner 1M and toner 1C) prepared above were sequentially loaded in the developing apparatus and 3000 sheets were printed in a high temperature and high humidity environment (30° C., 80% RH).

To evaluate the initial performance evaluation of the developing roller, the toner image quality and the residual potential of the developing roller were examined after printing 10 sheets of an A4 size document at 20% coverage (a full color mode in which the coverage for each of the colors: yellow, magenta, cyan and black, was 5%).

Subsequently, 5000 sheets at 2% coverage were printed (a full color mode in which the coverage for each of the colors: yellow, magenta, cyan and black, was 0.5%).

The performance evaluation after the printing of the 5000 sheets was carried out by printing 10 sheets of an A4 size document with the same coverage as the initial performance evaluation which was 20% (a full color mode in which the coverage for each of the colors: yellow, magenta, cyan and black, was 5%) and then evaluation was carried out on toner image quality (image density and halftone image) and peeling of the coating layer. The evaluation criteria of A and B were considered to be acceptable.

<Peeling of the Coating Layer>

Peeling of the coating layer was evaluated by removing developing rollers after 5000 sheets had been printed and peeling of the coating layer was visually evaluated.

A: No peeling of the coating layer was observed

B: Slight peeling of the coating layer at the end was observed, however, acceptable for practical use.

C: Peeling of the coating layer at the end was observed, which is unacceptable for practical use.

<Image Density>

The image density was evaluated by measuring the density of the solid black image at 12 points initially and after printing 5000 sheets using a reflection densitometer "RD-918 (manufactured by Macbeth)". The image density of 1.25 or more was considered to be acceptable.

Evaluation Criteria

Density of solid black image of 1.40 or greater is in an excellent level

Density of solid black image not less than 1.25 and less than 1.40 is in an acceptable level for practical use Density of solid black image less than 1.25 is in an unacceptable level for practical use.

<Density Unevenness in Halftone Image (including Black Spots and White Spots)>

Density unevenness in a halftone image was evaluated by visually observing a printed image after printing of 5000 sheets.

Evaluation Criteria

A: Uniform image without density unevenness in the halftone portion was obtained B: Slight streak-like low density unevenness, black spots and white spots were observed in the halftone portion, however, the print was acceptable for practical use C: Several streak-like low density unevenness, black spots and white spots were observed in the halftone portion, which were unacceptable for practical use The results of evaluation were summarized in Tables 3 and 4.

TABLE 3

| | Developing roller No. | Interlayer adhesive strength | Coating layer peeling | Image density | Unevenness in Halftone image density |
|---|---|---|---|---|---|
| Example 1 | Developing roller 1 | 11.2 | A | 1.42 | A |
| Example 2 | Developing roller 2 | 11.0 | A | 1.41 | A |
| Example 3 | Developing roller 3 | 11.2 | A | 1.42 | A |
| Example 4 | Developing roller 4 | 11.4 | A | 1.43 | A |
| Example 5 | Developing roller 5 | 11.5 | A | 1.43 | A |
| Example 6 | Developing roller 6 | 12.2 | A | 1.43 | A |
| Example 7 | Developing roller 7 | 11.2 | A | 1.42 | A |
| Example 8 | Developing roller 8 | 9.8 | A | 1.42 | A |
| Example 9 | Developing roller 9 | 9.5 | A | 1.40 | A |
| Example 10 | Developing roller 10 | 9.3 | B | 1.42 | A |
| Example 11 | Developing roller 11 | 9.0 | B | 1.41 | A |
| Example 12 | Developing roller 12 | 8.5 | B | 1.32 | A |
| Example 13 | Developing roller 13 | 9.0 | B | 1.42 | A |
| Example 14 | Developing roller 14 | 8.2 | B | 1.43 | A |
| Example 15 | Developing roller 15 | 9.0 | B | 1.42 | B |

TABLE 4

| | Developing roller No. | Interlayer adhesive strength | Coating layer peeling | Image density | Unevenness in Halftone image density |
|---|---|---|---|---|---|
| Example 16 | Developing roller 16 | 4.3 | B | 1.39 | B |
| Example 17 | Developing roller 17 | 4.2 | B | 1.38 | B |
| Example 18 | Developing roller 18 | 7.3 | B | 1.30 | B |
| Example 19 | Developing roller 19 | 8.0 | B | 1.30 | A |
| Comparative example 1 | Developing roller 20 | 3.2 | C | 1.30 | B |
| Comparative example 2 | Developing roller 21 | 3.0 | C | 1.28 | B |
| Comparative example 3 | Developing roller 22 | 6.0 | B | 1.12 | C |
| Comparative example 4 | Developing roller 23 | 5.0 | B | 1.14 | C |
| Comparative example 5 | Developing roller 24 | 3.9 | C | 1.31 | B |
| Comparative example 6 | Developing roller 25 | 3.0 | B | 1.23 | C |
| Comparative example 7 | Developing roller 26 | 7.0 | B | 1.23 | B |
| Comparative example 8 | Developing roller 27 | 6.8 | B | 1.24 | C |
| Comparative example 9 | Developing roller 28 | 3.7 | C | 1.33 | B |
| Comparative example 10 | Developing roller 29 | 3.8 | C | 1.36 | B |
| Comparative example 11 | Developing roller 30 | 7.0 | B | 1.24 | B |
| Comparative example 12 | Developing roller 31 | 7.5 | B | 1.23 | B |

As shown in Tables 3 and 4, interlayer adhesive strength, image density, halftone image unevenness, image cloudiness and coating layer peeling were all favorable for the "developing rollers 1-19" of examples 1-19, while each of "developing rollers 20-31" of the Comparative Examples 1-12 showed one or more unfavorable results in some of the described items, exhibiting that the effect of the present invention could not fully obtained when developing rollers 20-31 were used.

Similar results were obtained when a different outer diameter, thickness, Mg content or Cr content of the shaft, or a different coating layer, from those shown in Tables 1 and 2, are applied.

What is claimed is:

1. A developing roller comprising:

a shaft comprising an aluminum alloy; and a coating layer directly formed on a periphery of the shaft, the coating layer comprising a conducting agent and a binder comprising a resin, wherein the aluminum alloy comprises 0.2 to 0.8% by mass of silicon and 0.05 to 1.5% by mass of manganese, based on the total mass of the aluminum alloy; and a thickness of the coating layer is 1-30 μm; and the developing roller supplies a toner to a photoreceptor drum.

2. The developing roller of claim 1, wherein the aluminum alloy further comprises 0.4 to 6.0% by mass of magnesium and 0.04 to 0.35% by mass of chromium, based on the total mass of the aluminum alloy.

3. The developing roller of claim 1, wherein the resin is a siloxane modified polyurethane resin.

4. The developing roller of claim 1, wherein the resin is an acrylic resin.

5. The developing roller of claim 1, wherein the resin is a polyamide resin.

6. The developing roller of claim 1, wherein the binder consists of a resin.

7. The developing roller of claim 6, wherein the aluminum alloy further comprises 0.4 to 6.0% by mass of magnesium and 0.04 to 0.35% by mass of chromium, based on the total mass of the aluminum alloy.

8. The developing roller of claim 6, wherein the resin is a siloxane modified polyurethane resin.

9. The developing roller of claim 6, wherein the resin is an acrylic resin.

10. The developing roller of claim 6, wherein the resin is a polyamide resin.

11. A developing apparatus comprising a photoreceptor drum and a developing roller, the developing roller comprising:

a shaft comprising an aluminum alloy; and a coating layer directly formed on a periphery of the shaft, the coating layer comprising a conducting agent and a binder comprising a resin, wherein the aluminum alloy comprises 0.2 to 0.8% by mass of silicon and 0.05 to 1.5% by mass of manganese, based on the total mass of the aluminum alloy; and a thickness of the coating layer is 1-30 μm.

12. The developing apparatus of claim 11, wherein the aluminum alloy further comprises 0.4 to 6.0% by mass of magnesium and 0.04 to 0.35% by mass of chromium, based on the total mass of the aluminum alloy.

13. The developing apparatus of claim 11, wherein the resin is a siloxane modified polyurethane resin.

14. The developing apparatus of claim 11, wherein the resin is an acrylic resin.

15. The developing apparatus of claim 11, wherein the resin is a polyamide resin.

16. The developing apparatus of claim 11, wherein the binder consists of a resin.

17. The developing apparatus of claim 16, wherein the aluminum alloy further comprises 0.4 to 6.0% by mass of magnesium and 0.04 to 0.35% by mass of chromium, based on the total mass of the aluminum alloy.

18. The developing apparatus of claim 16, wherein the resin is a siloxane modified polyurethane resin.

19. The developing apparatus of claim 16, wherein the resin is an acrylic resin.

20. The developing apparatus of claim 16, wherein the resin is a polyamide resin.

21. The developing roller of claim 1, wherein the thickness of the coating layer is 5-20 μm.

22. The developing apparatus of claim 11, wherein the thickness of the coating layer is 5-20 μm.

23. A method of forming an image comprising:

forming an electrostatic latent image on a photoreceptor drum; and developing the electrostatic latent image by supplying a toner from a developing roller to the photoreceptor drum to form a toner image, wherein the developing roller comprises:

a shaft comprising an aluminum alloy; and a coating layer directly formed on a periphery of the shaft, the coating layer comprising a conducting agent and a binder comprising a resin;

wherein the aluminum alloy comprises 0.2 to 0.8% by mass of silicon and 0.05 to 1.5% by mass of manganese, based on the total mass of the aluminum alloy; and a thickness of the coating layer is 1-30 μm.

* * * * *